United States Patent [19]

Schäfer et al.

[11] Patent Number: 4,878,758

[45] Date of Patent: Nov. 7, 1989

[54] PROCESS FOR MIXING BULK MATERIALS

[75] Inventors: Roland Schäfer, Ortenberg; Farid Rizk, Neuhofen, both of Fed. Rep. of Germany

[73] Assignee: Harth & Seifert GmbH, Grossenluder, Fed. Rep. of Germany

[21] Appl. No.: 154,326

[22] Filed: Feb. 10, 1988

[30] Foreign Application Priority Data

Feb. 13, 1987 [DE] Fed. Rep. of Germany ..... 3704535
Feb. 3, 1988 [DE] Fed. Rep. of Germany ..... 3803085

[51] Int. Cl.[4] ..... B01F 13/02; B01F 15/02

[52] U.S. Cl. ..... 366/101; 366/106; 366/107; 366/189; 366/192

[58] Field of Search ..... 366/101, 106, 107, 150, 366/189, 192, 103, 103, 104, 105; 118/62, 20, DIG. 5; 34/57 A, 241, 57 R; 222/195

[56] References Cited

U.S. PATENT DOCUMENTS

| | | | |
|---|---|---|---|
| 2,886,899 | 5/1959 | Watkins | 34/57 A |
| 3,097,828 | 7/1963 | Grun | 222/195 |
| 4,128,343 | 12/1978 | Moked et al. | 366/101 |
| 4,168,913 | 9/1979 | Kono | 366/101 X |
| 4,223,044 | 9/1980 | Se | 366/101 X |
| 4,472,062 | 9/1984 | Balzau et al. | 366/107 X |
| 4,655,603 | 4/1987 | Palm | 366/107 |

FOREIGN PATENT DOCUMENTS

| | | | |
|---|---|---|---|
| 2034818 | 2/1972 | Fed. Rep. of Germany | 366/101 |
| 1070905 | 12/1985 | Fed. Rep. of Germany . | |

OTHER PUBLICATIONS

Wendel, "Gasstrahlmischer pneumatische Mischeinrichtung fur Schuttguter".

*Primary Examiner*—Harvey C. Hornsby
*Assistant Examiner*—Scott J. Haugland
*Attorney, Agent, or Firm*—Marmorek, Guttman & Rubenstein

[57] ABSTRACT

The instant invention relates to a process for the blending of bulk materials by means of a jet gas blender, whereby the blending porcess is initiated only when full gas pressure is reached and when the valve immediately upstream of the storage tank (3) has been closed. At the end of the set time period "$t_1$" the valve (4) leading to the blending container (6) is closed in effect simultaneously and the valve (4.1) leading to the storage tank (3) is reopened, whereby the blended material settles in the blending container (6) without being disturbed by turbulence in this control position and whereby this phase is maintained for a set period of time.

Only at the end of that period of time is the line cross-section leading to the filter (8) opened to allow exhaust air to go through, and its passage is thereby adjusted so that the quantity of exhaust air going through the filter remains approximately constant per time unit.

When the pressure in the blending container (6) has dropped to the level of the atmospheric pressure the material is discharged via the discharge opening.

5 Claims, 1 Drawing Sheet

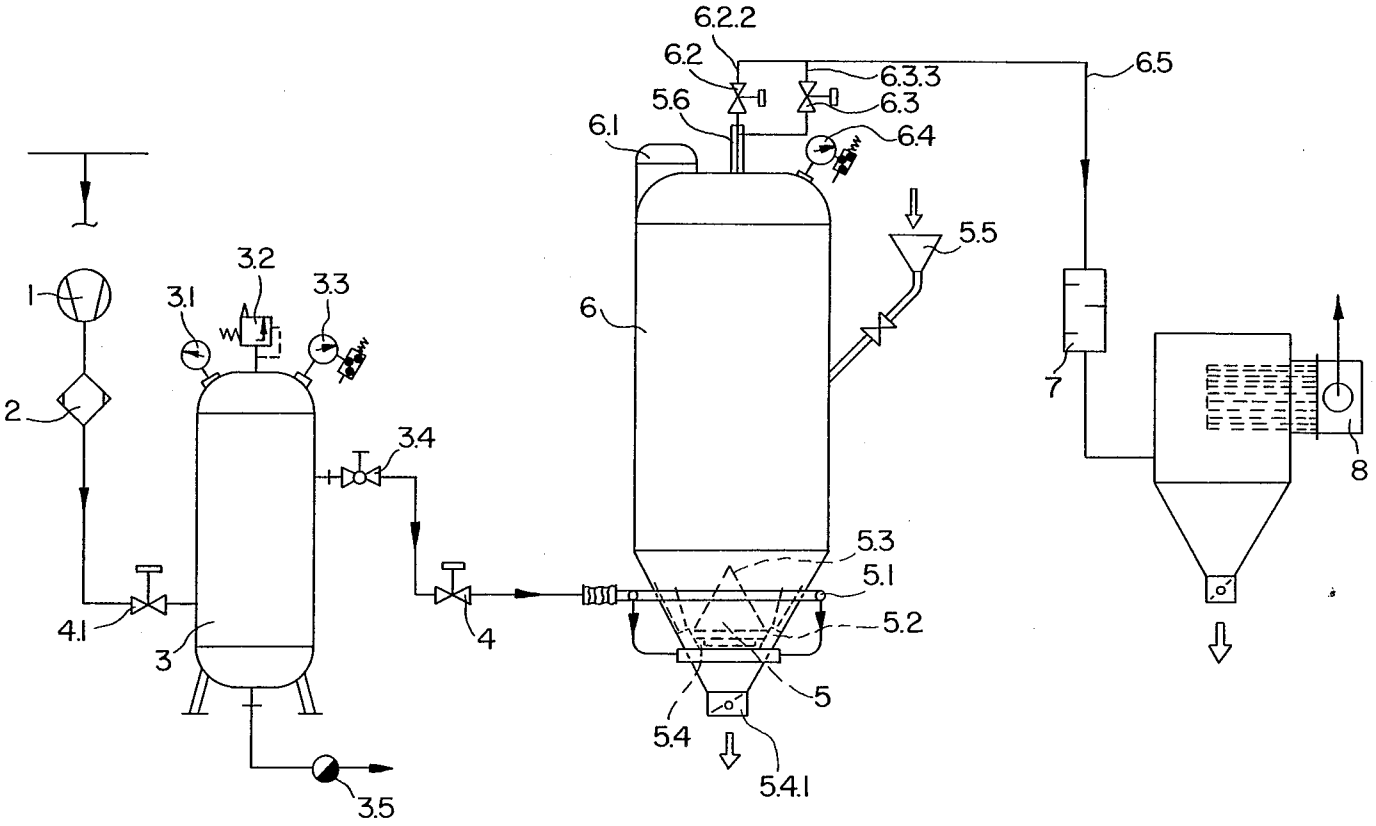
8
6.5
7
5.5
6.3.3
6.3
6.4
5.3
5.1
5.2
5
5.4.1
6.2.2
6.2
5.6
6.1
6
5.4
4
3.4
3.5
3.3
3.2
3.1
3
4.1
1
2

PROCESS FOR MIXING BULK MATERIALS

FIELD OF THE INVENTION

Description of The Prior Art

The instant invention relates to a process for the blending of fine-grained to powdery bulk materials, e.g. color pigments, by means of a jet gas blender constituted in a blending container equipped with a pressure-tight feeding and discharge opening, the lower part of said blending container being conical, its middle section being cylindrical and its upper section being preferably in the shape of a hood, said jet gas blender being connected on the discharge side to a filter via pipe lines and valves having different cross-sections as a rule, whereby the jet gas blender has a gross capacity of "x" $m^3$, its filling volume being x/2 $m^3$and its maximum free gas volume being x/2 $m^3$+the gas volume contained in the blended material, with an upstream sealable source of compressed gas designed for a maximum pressure of "p" bar and with a storage tank connected to same and capable of receiving the same maximum pressure "p" in turn connected to the blending container capable as a rule of receiving 2 to 10 times the gross volume via blending nozzles, whereby the pressure in the blending container is equal to the pressure "p" divided by the quotient of the maximum free volume of air in the blending container and of the storage tank.

Such a process can for example be applied by means of a device used to blend powder or granulated materials in accordance with German Patent No. 1,070,905.

The criterium of this device is a standing, cylindrical container with sealable filling and discharge openings, in the conical chamber floor of which, near its bottom, a crown of spray nozzles can be connected, said spray nozzles being directed upwards at an angle and in the same direction of rotation along the conical surface of the container bottom. The container cover leads into individual filter cylinders, said filter cylinders not being sealable in themselves so that the air is discharged through the filter cylinders with some delay as compared with the admission of the compressed air, resulting in the production of a higher pressure in the container during the treatment process than the exterior, atmospheric pressure.

Because of its simplicity it appears at first glance that this type of device could hardly be surpassed; however it does have some distinct disadvantages, in particular the fact that the pressure difference between the blending container and the outer atmosphere is low. Since the air brought in per time unit must however be removed again in practically the same time span, this solution requires large filter surfaces to keep the air clean.

A jet gas blender as described in a promotional brochure of the applicant is of similar design, special reference being made to the title page. According to the diagram shown there, the blending container is supplied in the manner described earlier from a compressed gas supply container which must be replenished, whereby the air is guided helicoidally upwards and is then again changed into a descending spout.

In contrast to the above-cited art a filter system was installed in the upper area of the blending container, whereby its filter hoses are supplied from outside and the exhaust gas is discharged above the filter. Here too, no sealing of the filter during the blending period is provided.

SUMMARY OF THE INVENTION

Based on the art mentioned initially, it is the object of the instant invention to define a process ensuring an intensive, practically constant blending effect during a continuous, predetermined yield time for a period lasting until the preset gas pressure between storage tank and blending container has been reached and during which satisfactory settling of the blended material is obtained while the danger of its being stirred up again is greatly reduced.

To achieve this objective the instant invention provides for the blending process to begin with the opening of a compressed-gas operated or electromagnetically operated or in part manually controlled valve between the storage tank and the blending container during application of full compressed air pressure "p" and simultaneous closing of a similarly controlled second valve upstream of the storage tank, for a stream of gas distribuited over the circumference of the blending container to be fed to same through blending nozzles for a first, set time period "$t_1$" and for the valve leading to the blending container to be closed and the valve leading to the storage container to be opened upon expiration of that time period, for the transfer of the blended material to take place upon completed change-over of the valves during a second, set time period "$t_2$" while the pressure in the blending container is maintained, for the overall line cross-section leading to the filter to be opened at the end of this second time period "$t_2$" and to be sized so that the exhaust air going through the filter remains nearly constant per time unit while the setting of the cross-section is changed from "small" to "large" during that time period, and for the blended material to be discharged after a lowering of the pressure to that of the environmental atmosphere and upon release of the discharge opening.

To sum up, it can be said again that the blending process is initiated only when the compressed air has reached full pressure and when the valve directly preceding the storage tank has been closed. Upon expiration of the set time period the valve leading to the blending container is closed in effect simultaneously with the re-opening of the valve leading to the storage tank, whereby the settling of the blended material takens place in the blending container during this control. phase without being disturbed by any turbulence, this phase being maintained for a period of time that can be set. It is only at the end of that time period that the line crossection leading to the filter is opened to let the exhaust air through and is thus adjusted in its passage so that the quantity per time unit of exhaust air passing through the filter remains approximately constant. After lowering the pressure in the blending container to atmospheric pressure the material is discharged through the discharge opening.

The requirement stated as an objective of the instant invention that the blending effect remain practically constant is met and the danger of renewed agitation of the settled dust through turbulence is eliminated by the proposed process.

The instant invention further provides for the stream of gas to be fed from the storage tank into the blending container either in one phase, during the time period "$t_1$" or, when this time period is divided into individual time segments, in portions, whereby the total time "$t_1$" remains unchanged and is determined by the prevailing, constant pressure of compressed gas in the storage tank and in the blending container.

The yield of stored energy for blending, whether or not the latter is in steps or under continuous addition of the compressed gas, remains practically equal at any seting as far as the overall effectiveness of the installation is concerned.

Concerning the settling phase of the blended material as a second process step, this limited second time period "$t_2$" is set by time relays emitting a signal at the end of the preset time period, whereby the signal gives the opening impulse for the crosssectional passage, closed until then, leading from the blending container to the filter.

At this end of a pre-set abatement period before opening the blending container towards the filter, the contents in noxious materials of the exhaust gas is reduced to a minimum, it being possible to make provisions in the adjustment of the time relay control to end the settling time "$t_2$" in function of the extent of translucency of the blending container immediately above the filling limit of the blended material.

The instantaneous static pressure in the blending container can also be used as an adjusting value to control the setting of the cross-section between the blending container and the filter unless the following alternative procedure is preferred, i.e. that the valves provided for the control of the cross-sectional setting between blending container and filter remain open or are omitted, provided that the exhauset gas line or the collection of exhaust gas ducts are of sufficient size for the pressure to decrease in the blending container during blending until it reaches the filter resistance.*

DESCRIPTION OF THE DRAWINGS

The instant invention is explained in further detail through the enclosed schematic drawings of a device proper to carry out the process. The schematic includes a gas storage tank having supply and discharge lines, a blender container connected to the storage tank discharge line and having an exhaust line connected through adjustable valves to a muffler and a filter.

DETAILED DESCRIPTION OF THE INVENTION

As a rule, a branch coming from the compressed gas utility network or pressure from a separate compressor used as the source of compressed gas 1 is brought through a gas drying installation 2 and to the storage tank 3, whereby the latter is equipped with a manometer 3.1, a safety valve 3.2, a contact manometer 3.3 for the controlled filling of the storage tank 3 and a condensate derivation 3.5.

The supply line between the source of compressed gas 1 and the storage tank 3 is controlled by a pneumatically controlled diaphragm valve 4.1 and is laid out so that the compressed gas coming from the storage tank 3 is fed via the open diaphragm valve 4 and on via the closed circular pipeline 5.1 and the nozzles 5.2 to the blending container until the diaphragm valve 4.1 controlling the supply to the storage tank 3 closes as maximum filling pressure is reached and is only open when the supplying diaphragm valve is closed as a balanced pressure is reached between containers 3 and 4.

Storage tank 3 can then again be filled at maximum pressure via diaphragm valve 4.1.

Both valves 4 and 4.1 are connected for control purposes so that one valve is always open and the other valve is always closed.

The manual non-return valve 3.4 as well as safety valve 3.2 constitute an independent safeguarding group for the case of control failure, especially if the control current or control gas is cut off.

The mixing head 5 is constituted by the closed circular gas pipeline 5.1 and the branching blendig nozzles 5.2 which enter the conical lower part of the blending container 6, are oriented radially and are evenly distributed and by a conical seal 5.3 located in their center for the discharge opening 5.4 which is secured by an additional butterfly valve 5.4.1, whereby the lifting of the conical seal 5.3 opens the discharge opening 5.4 while the material is admitted into the blending container 6 through one or more admission openings 5.4 capable of being sealed tightly against pressure. A large-size exhaust gas connection piece 5.6 is furthermore connected to the container closure, i.e. to the upper hood of the mixing container 6.

An overpressure diaphragm 6.1 designed for a pressure of 4 bar is attached to the blending container 6.

Two electrically controlled stop valves 6.2 and 6.3 are connected to the central exhaust gas connection piece 5.6, whereby valve 6.2 is provided for a low nominal width and valve 6.3 for a greater nominal width (alternate modification possibilities: see page *, last paragraph). The connected lines 6.2.2 and 6.3.3 merge into the collecting main 6.5 leading to the sound absorber 7, whereby sound absorber 7 is in turn connected to the filter 8.

The diaphragm contact manometer 6.4 which is also installed on the hood prevents additional air from being supplied during overpressure by closing the upstream, pneumatically controlled diaphragm valve 4, whereby this additional safety control takes precedence over the controls. While exhaust gas is being discharged towards filter 8, firt the smaller stop valve 6.2 and then, i.e. after drop-off of peak pressure, the larger stop valve is activated.

Other stop valves of different dimensions and capable of being activated one after the other could of course also be provided, so that practically continuous discharge of exhaust air can occur.

We claim:

1. A method of blending fine-grained to powdery bulk materials by means of a pressure-tight jet gas blender container equipped with a pressure-tight admission port, a discharge port, a gas intake port and a gas exhaust port, said method comprising the steps of:

(1) filling said blender container approximately half full with said bulk materials;

(2) opening a first valve between a source of compressed gas and a compressed gas storage tank, capable of filling said blender container with between twice and ten times its gross volume of gas, so as to fill said tank with said compressed gas;

(3) closing said first valve and simultaneously opening a second valve between said blender container and said storage tank for a predetermined blending time $t_1$, so that said compressed gas expands into said blender container through mixing nozzles located at the bottom of said blender container;

(4) simultaneously closing said second valve and opening said first valve for a predetermined settling time $t_2$ so that settling of the blended material can occur while the pressure in said blender container is maintained;

(5) at the end of said predetermined settling time $t_2$, opening third and fourth adjustable valves in said gas exhaust port, located between said blender container and a filter, in such a manner as to maintain the flow of gas through said exhaust port at an approximately constant flow rate; and (6) removing said blended material from said blender container through said discharge port after said pressure in said blender container equals atmospheric pressure.

2. A method as recited in claim 1, wherein said predetermined blending time $t_1$ is divided into individual separated time segments, and expansion of said compressed gas into said blender container takes place during said time segments.

3. A method as recited in claim 1, wherein said predetermined settling time $t_2$ is set by means of a time relay which emits a signal to said third and fourth adjustable valves, at the end of said predetermined settling time $t_2$.

4. A method as recited in claim 2, wherein activation of said time relay is determined by the extent of translucency of said blending container immediately above the filling limit of the blended material.

5. A method as recited in claim 1, wherein control of said third and fourth valves is a function of the instantaneous static pressure in said blender container.

* * * * *